United States Patent [19]

Andres et al.

[11] 4,034,153

[45] July 5, 1977

[54] ELECTRICAL CABLE FOR TRANSPORT VEHICLES AND SHIPS

[75] Inventors: Werner Andres, Muttenz; Ernst Diehl; Werner Marti, both of Breitenbach, all of Switzerland

[73] Assignee: Schweizerische Isola-Werke, Breitenbach, Switzerland

[22] Filed: Aug. 15, 1975

[21] Appl. No.: 604,938

[30] Foreign Application Priority Data

Nov. 18, 1974 Switzerland ..... 15325/74
Feb. 4, 1975 Austria ..... 816/75

[52] U.S. Cl. ..... 174/120 SR; 174/120 R; 174/120 C

[51] Int. Cl.[2] ..... H01B 7/00

[58] Field of Search ..... 174/110 N, 120 R, 120 SR, 174/120 C, 121 R, 121 SR, DIG. 8

[56] References Cited

UNITED STATES PATENTS

| | | | |
|---|---|---|---|
| 3,101,845 | 8/1963 | Heasley | 174/120 R |
| 3,425,865 | 2/1969 | Shelton | 174/121 R |
| 3,473,986 | 10/1969 | Hurtau | 174/120 R |
| 3,669,157 | 6/1972 | Woodall | 174/DIG. 8 |
| 3,801,393 | 4/1974 | Bilow | 174/110 N |

OTHER PUBLICATIONS

New Products Focus in Insulation Circuits, 1/72, p. 17.

*Primary Examiner*—E. A. Goldberg
*Attorney, Agent, or Firm*—Schiller & Pandiscio

[57] ABSTRACT

A flexible electrical power cable is described. The cable comprises a flexible metallic conductor and a plurality of alternately wrapped insulating layers comprising (1) at least two spirally wound layers of a tape made from mica paper and from a sheet of fibers which are resistant to temperatures up to at least 300° C, the tape being impregnated with an adhesive silicon resin and (2) a layer of temperature-resistant plastic film or sheeting which is stable to at least 300° C.

13 Claims, 2 Drawing Figures

Figure 1:
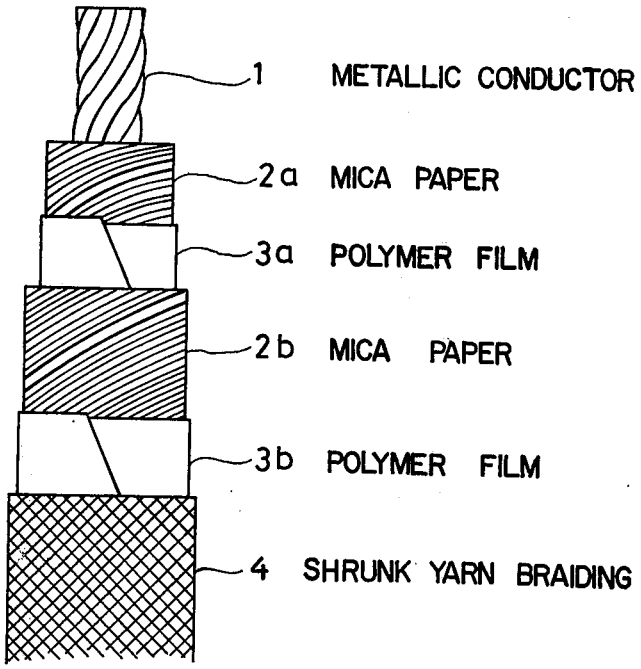

MEAN OUTER DIAMETER (mm)
24
22
20
18
16
14
12
10
8
6
4
2
A
B
100
200
300
400
500
PERMISSIBLE POWER LOAD (AMPERES)

ELECTRICAL CABLE FOR TRANSPORT VEHICLES AND SHIPS

Greater demands are made on cables for electrical wiring in rail vehicles and ships than on the cables normally used for installation. The cables must be resistant to oils such as diesel oils, transformer oils or lubricating oils. The cable insulation must not flow away or be deformed to any great extent under the pressure of a clamping collar (bride) or connecting terminal at the high temperatures reached in the neighbourhood of engines or motors, respectively. The high overloads which occur place considerable demands on the long-time heat resistance of the insulation materials and the temperature independence of their properties, e.g. of the dielectric strength and the mechanical properties.

The reliability in service is of paramount importance in view of the people and valuable loads carried by transport vehicles and ships. The cables used in these means of transport should not be combustible so that they fulfil their purpose even in the case of a fire in their vicinity.

Since space is short in vehicles and ships, the use of a cable is more advantageous the less space it takes up. The smaller the diameter of a cable for a particular purpose can be kept, the more advantageous it is to lay it. The flexibility of a cable is also important when installing it since it must be able to be bent round relatively tight curves without the use of special machines. The flexibility is favoured by a lower thickness of the insulation; it is particularly advantageous if certain layers within the insulation can slide past each other.

Electrical cables for railway vehicles must remain operational at temperatures as low as −30° C. and bent sections of the cable must not crack even at such low temperatures. On the other hand heavy demands are made on the moisture resistance of cables on ships.

Cables for ships and transport vehicles have hitherto been approved according to the regulations of the International Railway Union (IRU). Such cables consist for instance of a conductor which is covered by a cotton braiding. Over this there is an insulating layer of butyl rubber covered by a separating foil having a tape wound round it, and lastly an impregnated coverbraiding.

Owing to the use of butyl rubber this cable cannot be used at temperatures much higher than 100° C. Especially in railroad traction units, the operational temperatures of the engine are increasingly elevated however. In most countries railroad traction unit engines fall into class H, in which according to the regulations of the International Electrotechnical Commission (IEC) No. 349 temperatures of up to 220° C. can occur at the hottest point in the winding.

A higher temperature resistance could in itself be achieved by using silicone rubber instead of butyl rubber, but this is impossible owing to the insufficient resistance to oil of silicon rubber. If the silicone rubber were to swell under the influence of oil, any surrounding sheaths could either eventually be disrupted or the braiding could penetrate into the mechanically weakened insulation.

It has now been surprisingly found that it is possible to manufacture cables which are very suitable for the purposes mentioned above, i.e. for various voltages.

According to the invention, there is provided a flexible, incombustible cable for transport vehicles and ships comprising a flexible conductor made from aluminum, copper or nickel-plated or tin-plated copper, onto which conductor there are alternately wrapped A. at least two spirally wound layers of a tape made from mica paper and from a sheet of fibers which fibers are resistant to temperatures up to at least 300° C., the tape being impregnated with adhesive silicone resin which resin remains flexible after curing, and B. a layer of a temperature-resistant plastic film or sheeting which is preferably stable up to at least 300° C. and the overlapping regions of which are adhered to each other, said layer B being wound onto said first layers A, which layers A and B may be repeated as many times as desired, a cover-braiding of shrinkable yarn being applied over the outermost layer B.

Figure 2:
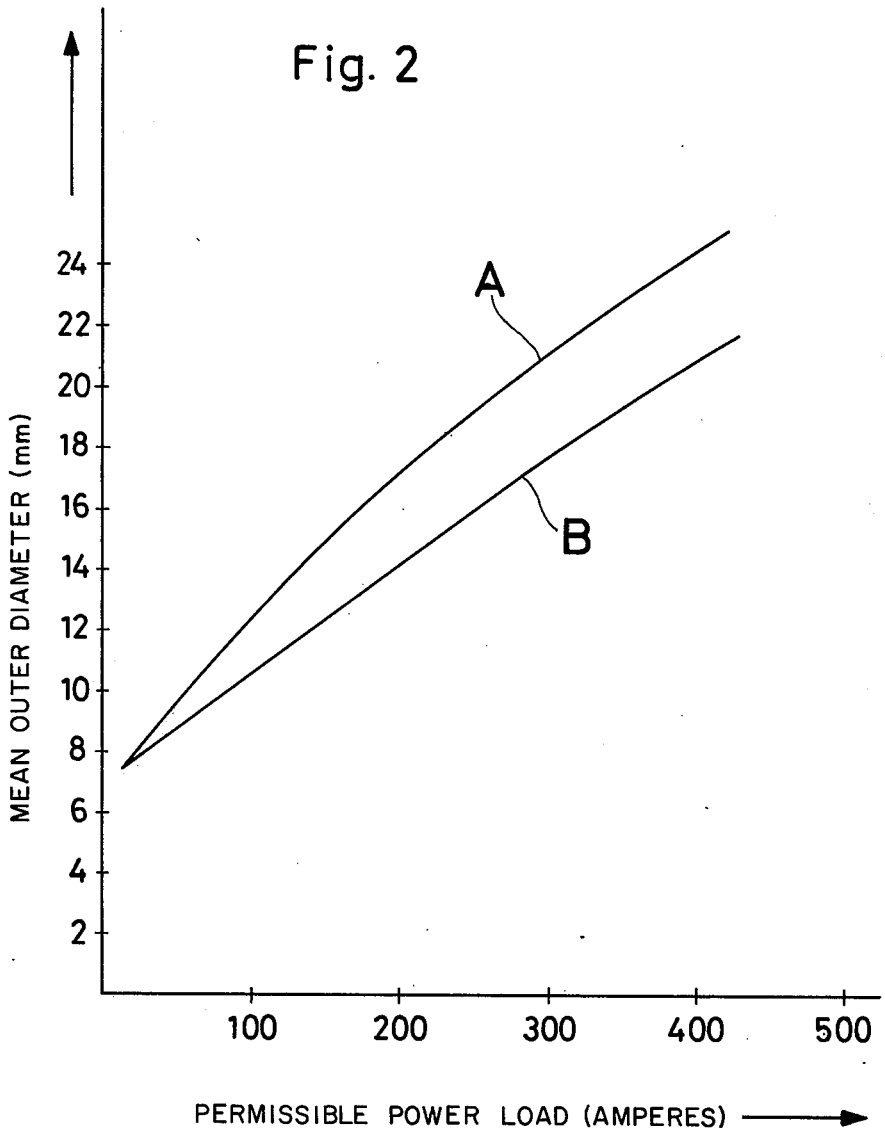

An embodiment of the cable of the invention is shown as a schematic cross-section in FIG. 1 of the drawing; and FIG. 2 is a graphical representation showing the power load as a function of the wire dimensions.

In FIG. 1 a flexible conductor 1, preferably a copper strand, is wound spirally with several layers 2a of a tape made from mica paper and from a sheet of fibers which are resistant to temperatures of up to at least 300° C. and are preferably not combustible. The tape is impregnated with an adhesive silicone resin which remains flexible in the cured state. The number of layers depends on the testing potential required. The layers can be wound on in the same or in opposite senses, the edges of the tape abutting or overlapping.

The sheet can be a woven or non-woven fabric, preferably made from mineral fibers, in particular a woven fiber-glass fabric. The mica paper can for instance contain 10 to 50 % by weight, preferably 20 to 30 % by weight, of cellulose fibers which preferably have a freeness of 20 to 60 on the Schopper-Riegler scale. Suitable as the adhesive silicone resin,which is used for the impregnation in the B-state, i.e. in the uncured state, are silicone resins like those used for adhesive tapes, e.g. the products sold by General Electric Company as SR 520, SR 527 and SR585 (Trade Marks) or by Usines Chimiques Rhone-Poulenc as Rhodorsil 4020 and 4085 (Trade Marks). The most important ingredient of these products appears to be tetrakis-(trimethylsilyl)-silicate of the formula $Si[OSi(CH_3)_3]_4$. Resins for the production of laminates or flexible resins do not come into consideration. The silicone resin penetrates through the sheet and the mica paper and fuses the layers together under the action of pressure and heat. It generally amounts to about 30 % by weight of the tape. The tape normally has a thickness of about 0.15 mm, e.g. 0.16 mm.

A layer **3*a* of a plastic film or sheeting, which is preferably resistant to temperatures of up to at least 300° C., is wound, half-overlapping for instance, onto at least two layers 2*a*** of this tape. In general, ca. 0.0025 mm thick films made from a polyester, e.g. polyethylene terephthalate, polyethylene naphthalate a polycarbonate or cellulose acetate, a polyimide or a polyhydantoin, come into consideration for this purpose. The layers of film serve as inner glide planes, improve the flexibility and make the insulation waterproof and gastight. The overlapping areas of plastic film can be adhered together with suitable adhesives which are non-adhesive at room temperature, soften when warmed and adhere the film permanently together by a chemical reaction. Suitable adhesives, e.g. isocyanate, esterimide or epoxide based resins, are known to those skilled in the art and can be obtained commercially.

At least two layers 2*b* of the tape impregnated with silicone resin follow in their turn on the plastic film layer 3*a*, then a plastic film layer 3*b* and so on in turn. A cover-braiding 4 of thermally shrinkable yarn, e.g. shrinkable tube made of polyester yarn, follows on the outermost plastic film layer (denoted by 3*b* in FIG. 1). This cover-braiding is preferably lacquered over with a high temperature resistant synthetic resin, such as an isocyanate lacquer or the like, to make the surface of the cable smooth and abrasionresistant, to prevent the adherence of dust and dirt and to give it the ability to slide necessary when laying the cable.

Since the insulation of the cable of the invention does not contain any elastomers such as butyl rubber or silicone rubber, it has a relatively high mica content and can, for a given voltage, be made thinner than conventional elastomer insulation.

The following table and FIG. 2 of the drawing allow a comparison of cables according to the invention (curve B) with the above-mentioned, known cables (curve A) which meet the requirements of the International Railway Union (IRU):

Table

| Nominal | Known cable | | Cable of FIG. 1 | |
|---|---|---|---|---|
| cross-section ($mm^2$) | Permissible power load (A) | Mean outer diameter (mm) | Permissible power load (A) | Mean outer diameter (mm) |
| 2.5 | 18 | 6.7 | 25 | 7.2 |
| 6.0 | 31 | 7.9 | 50 | 8.6 |
| 16.0 | 75 | 10.7 | 100 | 10.6 |
| 35.0 | 150 | 15.1 | 200 | 14.0 |
| 70.0 | 250 | 19.4 | 310 | 17.5 |
| 120.0 | 385 | 23.7 | 435 | 22.0 |

In follows from these values, which are represented graphically in FIG. 2, that the permissible power load for a given nominal crosss-section is 25 to 40 % higher with the cable of the invention than with the known cable and also that at higher nominal cross-sections the outer diameter of the cable of the invention can be smaller than that of the known cable in spite of the higher permissible power load. As a result the cable is more flexible. Since, as is well-known, mainly cables with a relatively large nominal cross-section are used, the space saving in cable ducts is considerable.

Since the cable of the invention contains almost no combustible material, it passes the combustibility tests laid down in the relevant standards, e.g. in IRU-Codex 895 VE for railway traction units and in Lloyds' Regulations for ships, and also the voltage test in water as laid down in Lloyds' Regulations as well as the tests under cold conditions as laid down in the above standards.

What we claim is:

1. In a flexible electrical cable comprising a flexible conductor made from metal selected from the group consisting of aluminum, copper, nickel-plated copper and tin-plated copper, and a flexible insulation covering the conductor, the improvement wherein said flexible insulation comprises:

A. at least four alternately disposed layers, at least two of said layers being spirally wound layers of mica tape, said mica tape (a) being made from mica paper and a heat resistant fiber sheet which is stable to temperatures up to at least 300° C., and (b) being impregnated with an adhesive silicone resin which resin remains flexible after curing, and the other two of said alternating layers each being a layer of a heat-resistant plastic film wound in overlapping relation onto a corresponding one of said two spirally wound layers of mica tape, with the overlapping regions of said film adhering to one another, and b. a cover-braiding of shrinkable yarn over the outermost layer of plastic film.

2. The cable of claim 1, wherein said cover-braiding of shrinkable yarn includes a water proof protective layer which layer also provides mechanical protection to said cable.

3. The cable of claim 1, wherein said flexible conductor comprises copper strand.

4. The cable of claim 1, wherein said fiber sheet comprises a woven fabric of incombustible fibers.

5. The cable of claim 4, wherein said fiber sheet comprises woven glass fabric.

6. The cable of claim 1, wherein said plastic film comprises a polymeric material selected from the group consisting of polyester, polyhydantoin and polyimide film.

7. The cable of claim 1, wherein said shrinkable yarn comprises polyester yarn.

8. The cable of claim 2, wherein said protective layer comprises a high temperature resistant lacquer.

9. The cable of claim 2, wherein said flexible conductor comprises copper strand, and said fiber sheet comprises woven glass fabric tape.

10. The cable of claim 1 wherein said plastic film is stable up to at least 300° C.

11. The cable of claim 1 wherein said fiber sheet comprises a non-woven incombustible fabric.

12. The cable of claim 11 wherein said sheet said comprises a mineral fiber.

13. The cable of claim 8 wherein said high temperature resistant lacquer comprises an isocyanate lacquer.

* * * * *